US008442243B2

(12) United States Patent
Akino

(10) Patent No.: US 8,442,243 B2
(45) Date of Patent: May 14, 2013

(54) RIBBON MICROPHONE

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 170 days.

(21) Appl. No.: 13/012,896

(22) Filed: Jan. 25, 2011

(65) Prior Publication Data

US 2011/0188680 A1 Aug. 4, 2011

(30) Foreign Application Priority Data

Jan. 29, 2010 (JP) ..... 2010-018457

(51) Int. Cl.

| | |
|---|---|
| ***H04R 25/00*** | (2006.01) |
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |

(52) U.S. Cl.
USPC ..... 381/176; 381/369

(58) Field of Classification Search ..... 381/176, 381/369
See application file for complete search history.

(56) References Cited

U.S. PATENT DOCUMENTS 2,896,491 A * 7/1959 Lover ..... 84/725
2006/0078135 A1* 4/2006 Royer et al. ..... 381/176

FOREIGN PATENT DOCUMENTS

JP 2009-118118 5/2009

* cited by examiner

*Primary Examiner* — Brian Ensey
*Assistant Examiner* — David J Ho
(74) *Attorney, Agent, or Firm* — Whitham Curtis Christofferson & Cook, PC

(57) ABSTRACT

A ribbon microphone includes two magnets spaced in parallel and generating a magnetic field therebetween, two ribbon diaphragms arranged in parallel at a predetermined distance in the magnetic field, and a step-up transformer raising the voltages of electric signals generated in response to vibrations of the ribbon diaphragms in the magnetic field and outputs the raised electric signals. The step-up transformer includes two primary windings and two secondary windings corresponding to the two ribbon diaphragms, one of the two ribbon diaphragms and one of the two primary windings of the step-up transformer are connected in parallel whereas the others are connected in parallel, and the two secondary windings of the step-up transformer are connected in series so as to have opposite polarities. The ribbon microphone exhibits enhanced shielding effect without shielding a step-up transformer and does not generate noise caused by electromagnetic induction.

1 Claim, 3 Drawing Sheets

RIBBON MICROPHONE

TECHNICAL FIELD

The present invention relates to a ribbon microphone and, in particular, to a technique for preventing noise caused by an external induction magnetic field in a ribbon microphone including two ribbon diaphragms (hereinafter simply referred to as "ribbons") and a step-up transformer.

BACKGROUND ART

A ribbon microphone includes a microphone case accommodating a ribbon microphone unit, a step-up transformer, a circuit board, a connector, and any other component. The ribbon microphone unit includes, as its main components, two magnets generating a magnetic field and a conductive ribbon. These magnets are arranged on the two sides of the ribbon, and a magnetic field is generated between these magnets. The ribbon is disposed in the magnetic field while two ends in its longitudinal direction are held under proper tension. The ribbon vibrates in the magnetic field in response to sound waves, and a current corresponding to the vibration flows through the ribbon. In this manner, the sound waves are converted into electric signals. Each magnet has a rod shape which has a rectangular cross-section. The two magnets are arranged in parallel with each other while one surface in the width direction of one of the magnets faces that of the other magnet across the ribbon. An aluminum foil has been widely used as the material for the ribbon. Aluminum has higher conductivity and a lower specific gravity than any other metallic material and is thus suitable for a ribbon of a ribbon microphone.

A typical conventional ribbon microphone unit is configured such that one ribbon is arranged in one magnetic field generated by magnets. Another commercially available ribbon microphone has two ribbons that are arranged at a predetermined space in parallel with each other in one magnetic field and that are connected in series. With this configuration, the ribbon microphone can produce an output of double magnitude. Such a double-ribbon microphone unit is disclosed in Japanese Patent Laid-Open No. 2009-118118 issued to the assignee of this application.

In a ribbon microphone unit including two ribbons as disclosed in Japanese Patent Laid-Open No. 2009-118118, ribbons are arranged at two ends in the anteroposterior direction of magnetic poles, i.e., at positions corresponding to two ends in the thickness direction of magnets. The two ribbons are electrically series-connected as described above. Since aural signals outputted by the two ribbons are weak, the signals are outputted as a microphone output after the voltage of the signals is raised with a step-up transformer. A ribbon microphone is bidirectional, and the front and rear ribbons are set equally in acoustic terms such that aural signals produced by the front and rear ribbons are bidirectional.

FIG. 3 shows a conventional ribbon microphone unit provided with two ribbons arranged in one magnetic field. The ribbon microphone unit 10 (hereinafter simply referred to as "unit 10") includes a yoke 12, two magnets 15, and two ribbons 16 and 17. With reference to FIG. 2, which illustrates an embodiment of the present invention, the yoke 12 is a vertically long rectangular frame. The yoke 12 has the rod-shaped magnets 15 having a rectangular cross-section and fixed to opposed vertical inner walls, respectively, of the yoke 12 in parallel at a distance. These magnets 15 are magnetized in a direction orthogonal to the opposed surfaces of the magnets 15, i.e., a direction orthogonal to the sheet surface in FIG. 3, and the magnetic poles of the magnets 15 are oriented in the same direction. As a result, a parallel magnetic field with a magnetic flux oriented in one direction is generated between the magnets 15.

In the magnetic field, the two ribbons 16 and 17 are arranged. The two ends in the longitudinal direction of each ribbon 16 or 17 are fixed under proper tension to respective terminal portions provided at the two ends in the longitudinal direction of the yoke 12. The ends of the ribbon 16 are electrically continuous with terminals 21 and 22 whereas the ends of the ribbon 17 are electrically continuous with terminals 23 and 24. One end in the longitudinal direction of each of the ribbons 16 and 17, i.e., the upper end in FIG. 3 is connected by a wire to the corresponding terminal portion of the yoke 12 via the terminal 21 or 23. The other end of the ribbon 16 is connected to one end of a primary winding 301 of a step-up transformer 30 via the terminal 22 whereas the other end of the ribbon 17 is connected to the other end of the primary winding 301 via the terminal 24. Accordingly, the ribbons 16 and 17 are connected in series such that output signals from the ribbons 16 and 17 are inputted to the primary winding 301 of the step-up transformer 30. The magnetic field extends over substantially the same range as the thickness of the magnets 15 (the lateral direction in FIG. 3 (the anteroposterior direction)), and the ribbons 16 and 17 are arranged near the two ends, respectively, in the anteroposterior direction of the magnetic field. This is because the unit 10 is not bidirectional unless the front and rear ribbons 16 and 17 are set equally in acoustic terms.

As shown in FIG. 3, sound waves v1 entering the ribbon microphone unit 10 from the front face of the ribbon 16 act on the ribbon 17. For convenience, sound waves acting on the ribbon 17 will be denoted by reference characters v2 hereinafter. The two ribbons 16 and 17 vibrate in response to the sound waves v1 and v2. Electromagnetic conversion causes currents i1 and i2 corresponding to the sound waves v1 and v2 to flow through the ribbons 16 and 17, respectively. Since the upper ends of the two ribbons 16 and 17 are connected in series via the terminals 21 and 23 in FIG. 3, the currents i1 and i2 flowing through the ribbons 16 and 17 are opposite in direction and are equal in magnitude. The current i1 (=i2) flows into the primary winding 301 of the step-up transformer 30.

The step-up transformer 30 is an output transformer of the ribbon microphone unit 10, has a turns ratio of as high as, for example, 1:70, and raises an output voltage of the unit 10 about 70 times and output the raised voltage. Not only a microphone unit including two ribbons as shown in FIG. 3 but also a microphone unit including one ribbon outputs an extremely low voltage. Accordingly, the step-up transformer has a turns ratio of as high as 1:70.

SUMMARY OF INVENTION

As described above, the ribbon microphone including the step-up transformer 30 with a high rate of rise of voltage readily generates noise in aural signals by, for example, penetration of an induction magnetic field H from a commercial AC power supply into the step-up transformer 30. For this reason, penetration of an induction magnetic field is conventionally prevented by covering the entire step-up transformer 30 with a shielding member, a shielding case, or any other shielding means. However, shielding of the entire step-up transformer 30 requires a bulky-shielding member. More secure shielding of the entire step-up transformer 30 requires a higher thickness of the shielding member. This results in a further increase in the size of the step-up transformer 30.

An object of the present invention is to provide a ribbon microphone capable of solving problems with a conventional ribbon microphone, i.e., having enhanced shielding effect and not generating noise caused by electromagnetic induction without shielding a step-up transformer that is an output transformer, utilizing the structural feature of a ribbon microphone including two ribbons.

The ribbon microphone of the present invention includes: a pair of magnets spaced in parallel with each other, the pair of magnets generating a magnetic field therebetween; two ribbon diaphragms arranged in parallel with each other at a predetermined distance in the magnetic field between the pair of magnets; and a step-up transformer which raises the voltages of electric signals generated in response to vibrations of the two ribbon diaphragms in the magnetic field and outputs the electric signals, in which the step-up transformer includes two primary windings and two secondary windings corresponding to the two ribbon diaphragms, one of the two ribbon diaphragms and one of the two primary windings of the step-up transformer are connected in parallel with each other whereas the other of the two ribbon diaphragms and the other of the two primary windings of the step-up transformer are connected in parallel with each other, and the two secondary windings of the step-up transformer are connected in series so as to have opposite polarities.

The two ribbon diaphragms (hereinafter simply referred to as "ribbons") vibrate in response to sound waves. Electromagnetic conversion generates electric signals corresponding to the sound waves in the ribbons. The electric signals generated in the ribbons are inputted to the respective primary windings of the step-up transformer, and the voltages of the electric signals are raised by the step-up transformer. Since the two secondary windings of the step-up transformer are connected in series so as to have opposite polarities, even if an external magnetic field penetrates into the step-up transformer, noises generated in the two secondary windings by electromagnetic induction are in opposite phase to each other and cancel each other out. The ribbon microphone thus can exhibit sufficient shielding effect without covering the entire step-up transformer with a magnetic shielding case made of an expensive material such as permalloy. Accordingly, a ribbon microphone including inexpensive compact shielding means can be provided.

DESCRIPTION OF EMBODIMENTS

Figure 1:
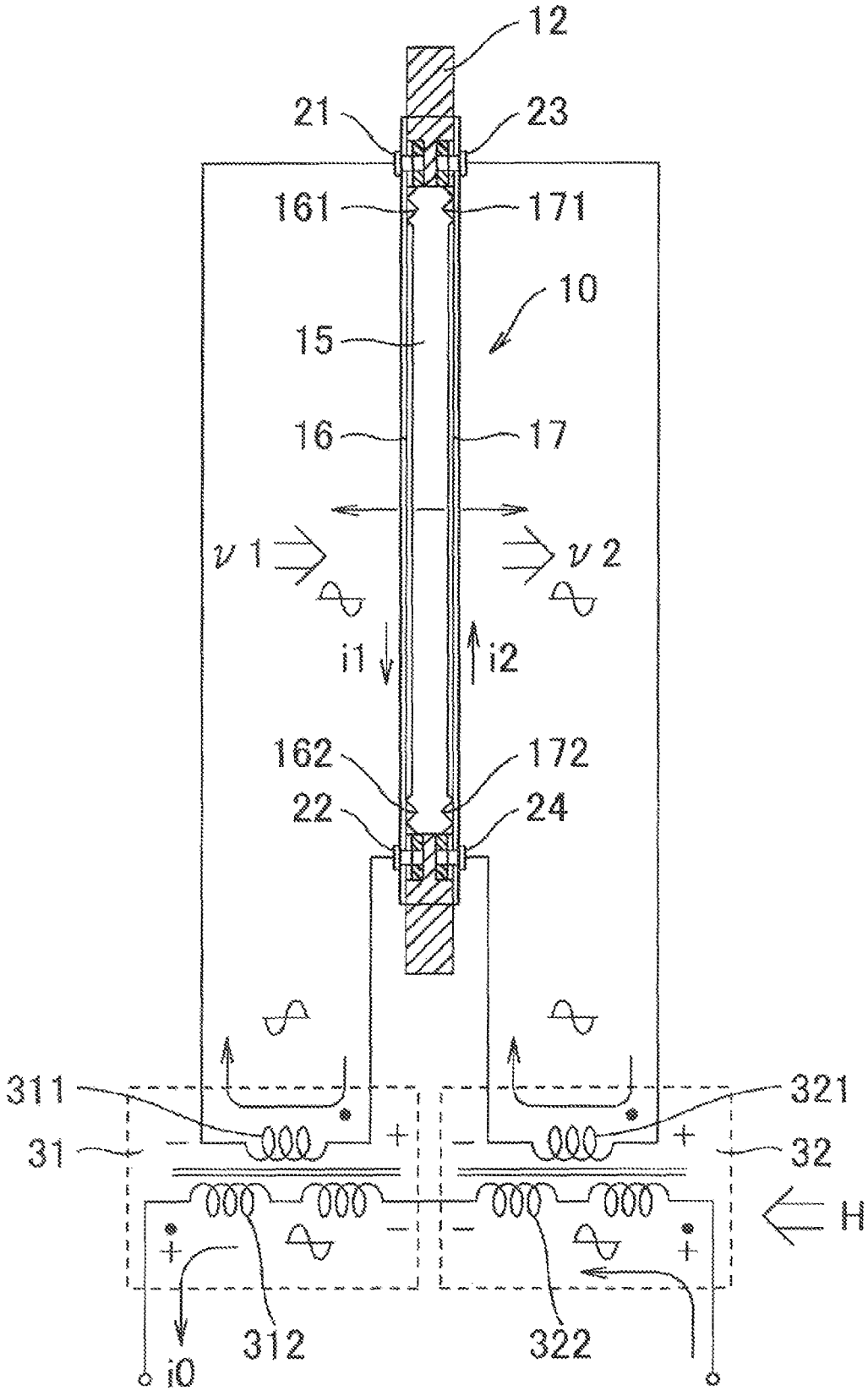
FIG. 1 is a longitudinal sectional view provided with a circuit diagram illustrating a ribbon microphone according to an embodiment of the present invention.

A ribbon microphone according to an embodiment of the present invention will be described below with reference to FIGS. 1 and 2. The ribbon microphone unit has the same physical configuration as that of the conventional example shown in FIG. 3, and the same components are denoted by the same reference numerals.

Figure 2:
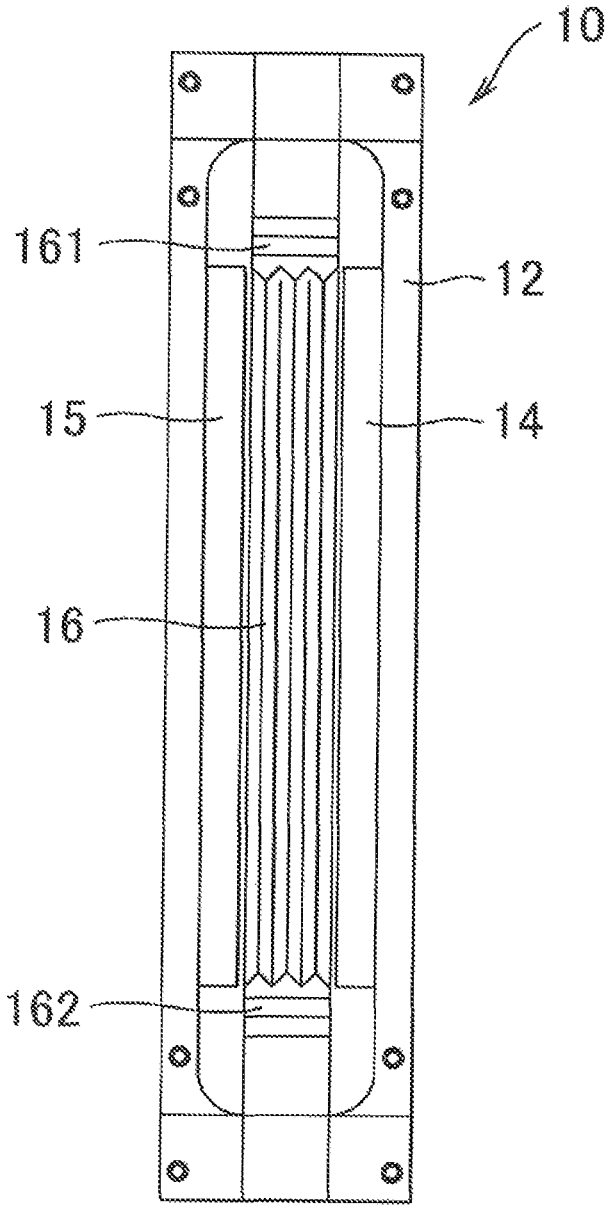
FIG. 2 is a front view of the ribbon microphone according to the embodiment.
Figure 3:
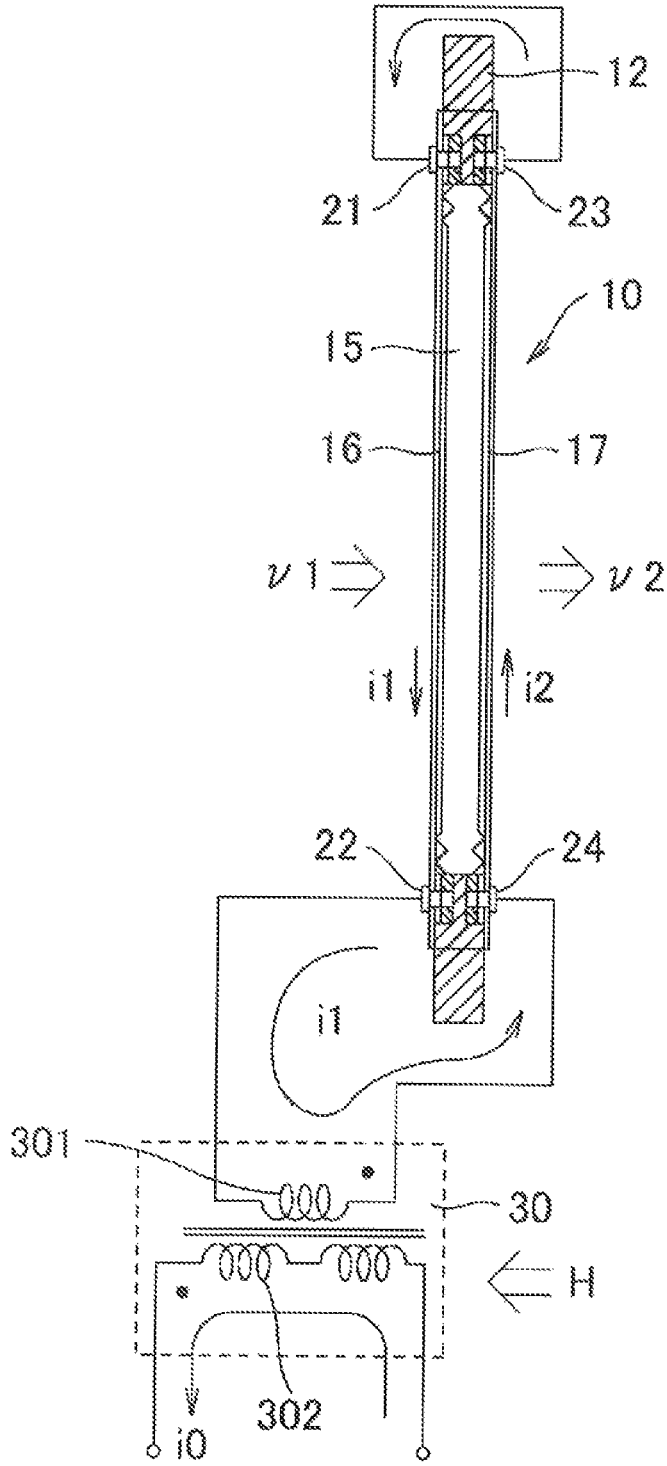
RELATED ART FIG. 3
FIG. 3 is a longitudinal sectional view provided with a circuit diagram showing a conventional ribbon microphone.

Referring to FIGS. 1 and 2, a ribbon microphone unit (hereinafter simply referred to as "unit") 10 includes a yoke 12, two magnets 14 and 15, and two ribbons 16 and 17. The anteroposterior direction of the unit 10 corresponds to the lateral direction in FIG. 1. FIG. 2 shows the unit 10 as seen from the front. As shown in FIG. 2, the yoke 12 has a shape of a vertically long rectangular frame. The yoke 12 has rod-shaped magnets 14 and 15 that have a rectangular cross-section and are fixed to opposed left and right vertical inner walls, respectively, of the yoke 12 with a predetermined space therebetween in parallel with each other. These magnets 14 and 15 are magnetized in a direction orthogonal to opposed surfaces of the magnets 14 and 15, i.e., a direction orthogonal to the sheet surface in FIG. 1 and the lateral direction in FIG. 2, and the magnetic poles of the magnets 14 and 15 are oriented in the same direction. A magnetic field with a parallel magnetic flux oriented in one direction is thus generated between the magnets 14 and 15.

The two ribbons 16 and 17 are arranged in the magnetic field. The ribbons 16 and 17 in the illustrated embodiment each have a corrugated cross-section at a large portion extending in its longitudinal direction. The first corrugated portions of the ribbons 16 and 17 each have ridges parallel to the longitudinal direction. The ribbons 16 and 17 with the first corrugated portions have a certain degree of resiliency. Two ends in the longitudinal direction of each ribbon 16 or 17 are fixed under proper tension to terminal portions provided at two ends in the longitudinal direction of the yoke 12. Each ribbon 16 or 17 has second corrugated portions, each being provided between the corrugated cross-sectional portion and the end fixed to the corresponding terminal portion, the second corrugated portion being oriented perpendicular to the first corrugated portion. The second corrugated portions of the ribbon 16 or 17 each have ridges parallel to the width direction. The second corrugated portions are referred to as resiliently deformable portions 161, 162, 171, and 172, respectively. The ribbon 16 has the resiliently deformable portions 161 and 162 whereas the ribbon 17 has the resiliently deformable portions 171 and 172. With this configuration, the ribbons 16 and 17 can vibrate in reaction to sound waves.

As shown in FIG. 1, two step-up transformers 31 and 32 are provided to correspond to the two ribbons 16 and 17. The step-up transformers 31 and 32, respectively, raise the voltages of electric signals generated in the ribbons 16 and 17 in response to vibrations of the ribbons 16 and 17 in the magnetic field and output the electric signals. The step-up transformer 31 includes a primary winding 311 and a secondary winding 312 while the step-up transformer 32 includes a primary winding 321 and a secondary winding 322. The step-up transformers 31 and 32 may be separately provided corresponding to the two ribbons 16 and 17 or may have a common core on which the two primary windings 311 and 321 of the step-up transformers are wound independently of each other and the two secondary windings 312 and 322 are wound independently of each other. The phrase "wound independently of each other" refers to "not wound so as to form a tapped continuous winding." If the two step-up transformers 31 and 32 are separately provided, these step-up transformers 31 and 32 are arranged in the same orientation and in the same posture so as to be equally affected by an external magnetic field.

The electrical connections among the two ribbons 16 and 17 and the primary windings 311 and 321 and the secondary windings 312 and 322 of the step-up transformers will be described. As shown in FIG. 1, the two ends of the ribbon 16 are electrically continuous with terminals 21 and 22 whereas the two ends of the ribbon 17 are electrically continuous with terminals 23 and 24. One end in the longitudinal direction of the ribbon 16, i.e., the upper end in FIGS. 1 and 2 is connected by a wire to a negative end of the primary winding 311 of the step-up transformer 31 via the terminal 21 whereas the lower end of the ribbon 16 is connected by a wire to a positive end of the primary winding 311 via the terminal 22. One end in the longitudinal direction of the ribbon 17, that is, the upper end in FIGS. 1 and 2 is connected by a wire to the positive end of the primary winding 321 of the step-up transformer 32 via the terminal 23 whereas the lower end of the ribbon 17 is connected by a wire to the negative end of the primary winding 321 via the terminal 24. Accordingly, the two ribbons 16 and 17 are connected in parallel with the primary windings 311 and 321 of the two step-up transformers 31 and 32, respectively. More specifically, one of the two ribbon diaphragms and one of the two primary windings of the step-up transformers are connected in parallel, and the other of the two ribbon diaphragms and the other of the two primary windings of the step-up transformers are connected in parallel. Note that the ribbons 16 and 17 are connected to the respective primary windings at the ends opposite in polarity to each other. The secondary windings 312 and 322 of the two step-up transformers 31 and 32 are connected in series so as to have opposite polarities. In the unit shown in FIG. 1, a negative end of the secondary winding 312 and a negative end of the secondary winding 322 are connected, and positive ends of the secondary windings 312 and 322 output signals.

The operation of the ribbon microphone according to the embodiment and, more particularly, the operation of the step-up transformers 31 and 32 will be described. Assume that, as shown in FIG. 1, sound waves v1 enter the ribbon microphone unit 10 from the front of the ribbon 16 and sound waves v2 exits the ribbon microphone unit 10 from the back of the ribbon 17. The sound waves v1 and v2 are substantially the same sound waves and are in phase with each other. The two ribbons 16 and 17 vibrate in response to the sound waves v1 and v2, respectively. The ribbons 16 and 17, which cross the magnetic flux between the magnets 14 and 15, output signals corresponding to the sound waves v1 and v2. Currents i1 and i2 shown in FIG. 1 are electric currents which are generated by electromagnetic conversion and flow through the ribbons 16 and 17, respectively. Since the two ribbons 16 and 17, respectively, are connected in parallel with the primary windings 311 and 321 of the two step-up transformers 31 and 32 at the ends opposite in polarity to each other, the currents flowing through the primary windings 311 and 321 are in opposite phase each other.

At the secondary windings 312 and 322 of the two step-up transformers 31 and 32, secondary currents are induced by the currents i1 and i2 flowing through the respective primary windings 311 and 321. The currents flowing through the primary windings 311 and 321 are in opposite phase each other. Since the secondary windings 312 and 322 are connected in series so as to have opposite polarities, a current i0 of one phase, which is the sum of the currents induced at the secondary windings 312 and 322, flows through the secondary windings 312 and 322. With the electrical connections among the two ribbons 16 and 17 and the two step-up transformers 31 and 32 shown in FIG. 1, output signals can be obtained in the above-described manner.

As described above with reference to the conventional ribbon microphone unit, the step-up transformers 31 and 32 are output transformers of the ribbon microphone unit 10, have turns ratios of as high as, for example, 1:70, and raise output voltages of the unit 10 about 70 times and output the raised voltages. As described above, a ribbon microphone including a step-up transformer having such a high turns ratio (a high rate of rise of voltage) readily generates noise in aural signals by, for example, penetration of an induction magnetic field H from a commercial AC power supply into a step-up transformer. However, according to the illustrated embodiment of the present invention, the secondary windings 312 and 322 of the two step-up transformers 31 and 32 are connected in series with each other so as to have opposite polarities. With this configuration, noises caused by penetration of an induction magnetic field H into the step-up transformers 31 and 32 are in opposite phase each other and cancel each other out. Accordingly, the step-up transformers 31 and 32 can cancel noises caused by an induction magnetic field even if the entire step-up transformers 31 and 32 are not covered with a shielding case or any other shielding means, unlike conventional ribbon microphone units. The step-up transformers 31 and 32 can have a very simple shielding means.

Industrial Applicability

A ribbon microphone outputs a weak signal in spite of its large physical size and readily generates noise caused by an induction magnetic field. Such a problem prevents the spread of ribbon microphones. Application of the technical idea of the present invention can contribute to the spread of ribbon microphones.

What is claimed is:

1. A ribbon microphone, comprising:

a pair of magnets spaced in parallel with each other, the pair of magnets generating a magnetic field therebetween;

two ribbon diaphragms arranged in parallel with each other at a predetermined distance in the magnetic field between the pair of magnets; and a step-up transformer which raises the voltages of electric signals generated in response to vibrations of the two ribbon diaphragms in the magnetic field and outputs the electric signals, wherein the step-up transformer comprises two primary windings and two secondary windings corresponding to the two ribbon diaphragms, one of the two ribbon diaphragms and one of the two primary windings of the step-up transformer are connected in parallel with each other and the other of the two ribbon diaphragms and the other of the two primary windings of the step-up transformer are connected in parallel with each other, the two secondary windings of the step-up transformer are connected in series so as to have opposite polarities, and wherein the two primary windings of the step-up transformer corresponding to the two ribbon diaphragms receive signals in opposite phase with each other which are generated through electromagnetic conversion by the two ribbon diaphragms, and the two secondary windings of the step-up transformer connected in series so as to have opposite polarities output signals having the same phase, and noises generated by electromagnetic induction are reduced or canceled out.

* * * * *